United States Patent [19]

Iwasaki

[11] Patent Number: 4,687,095

[45] Date of Patent: Aug. 18, 1987

[54] BOX PROVIDED WITH A LINT REMOVER AND DUST BRUSH

[75] Inventor: Shoichi Iwasaki, Maibaramachi, Japan

[73] Assignee: Iwasaki Sangyo Kabushiki Kaisha, Japan

[21] Appl. No.: 824,742

[22] Filed: Jan. 31, 1986

[30] Foreign Application Priority Data

Aug. 2, 1985 [JP] Japan ..... 60-118113[U]

[51] Int. Cl.[4] ..... B65D 81/00; B65D 85/00

[52] U.S. Cl. ..... 206/234; 15/104 A; 15/105; 15/106; 15/159 A; 132/85; 206/38

[58] Field of Search ..... 206/38, 234, 581, 361, 206/823; 15/104 A, 159 A, 105, 106; 132/85

[56] References Cited

U.S. PATENT DOCUMENTS

| | | | |
|---|---|---|---|
| 2,209,781 | 7/1940 | Lewis | 206/581 |
| 2,715,742 | 8/1955 | Coles | 15/105 |
| 2,851,713 | 9/1958 | Tupper | 15/105 |
| 3,089,170 | 5/1963 | Buchsbaum | 206/38 |
| 3,471,977 | 10/1969 | Roth | 15/105 |
| 3,477,763 | 11/1969 | Greichgauer | 15/159 A |
| 3,648,318 | 3/1972 | Tsuruzawa | 15/104 A |

FOREIGN PATENT DOCUMENTS

| | | |
|---|---|---|
| 55-116520 | 9/1980 | Japan . |
| 56-11833 | 1/1981 | Japan . |
| 59-132537 | 11/1984 | Japan . |

*Primary Examiner*—William Price
*Assistant Examiner*—Jimmy G. Foster
*Attorney, Agent, or Firm*—Lowe, Price, LeBlanc, Becker & Shur

[57] ABSTRACT

A box is provided with a lint remover and dust brush having many loops of rigid strings formed by entwining them with a cloth adhered to an external surface of the lid of said box, and a brush having many hairs vertically set in the bottom or side surface of said box.

15 Claims, 5 Drawing Figures

BOX PROVIDED WITH A LINT REMOVER AND DUST BRUSH

BACKGROUND OF THE INVENTION

1. Field of the Invention

This invention relates to cleaning of lint and dust attached to the surfaces of clothes, bedclothes, carpets, etc. made of textiles or knitted materials.

2. Description of the Prior Art

For cleaning clothes, cloth, carpets, and other textiles, the prior art relies primarily on brushes. Especially for removal of lint, there have been available in the prior art a brush with a handle, having rigid hairs or bristles set at a certain angle in a curved surface thereof; a pumiceous material which traps lint in its cavities when the surface of clothes or of a cloth is rubbed with it; and a box having a wide-mesh net stretched in a curved shape over its top open side for collecting lint in the meshes thereof when the surface of clothes, blankets, etc. is rubbed with said net. Further there is available a round roller on which is wound adhesive paper for removing lint and dust from clothes, blankets, etc. by being rolled over them.

However the above-mentioned tools have a number of disadvantages. For examples, when clothes or cloth is rubbed with said bristles, or rigid hairs of a brush, the bristles easily damage the fibers of textiles or knitted goods. When clothes, cloth or carpets are rubbed with said pumiceous material, the fine particles thereof may drop and soil said clothes, bedclothes or carpets; clothes and bedclothes will also be damaged when rubbed with said net which is made of strings hardened by resin, and once lint of clothes or carpets has been collected by adhesive paper, said roller using adhesive paper cannot continue to collect the lint, so that it gradually becomes unable to collect lint as the roller turns several times.

SUMMARY OF THE INVENTION

This invention provides a hollow box having many loops made of rigid strings set over a cloth attached to an external surface of a lid of the box, having a brush on a bottom- or side-external-surface thereof, and containing such small articles as a fillet for removing lint from said loops, spools, scissors, etc. therein, so that lint and dust attached to clothes, bedclothes, etc. made of woolen textiles like cashmere my be removed by a single tool.

According to the invention, lint occurring on the surface of woolen textiles which are used for clothing, such as cashmere, etc., can be scooped up by many loops set in the cloth on the external surface of the lid of a box, and dust on the surface of woolen and other textile products can be removed by a brush on the bottom external surface of said box. Further the needles and threads contained in said box are available for repair of woolen or knitted goods by opening the lid of said hollow box.

DESCRIPTION OF THE PREFERRED EMBODIMENTS

In the accompanying drawings.

Figure 1:
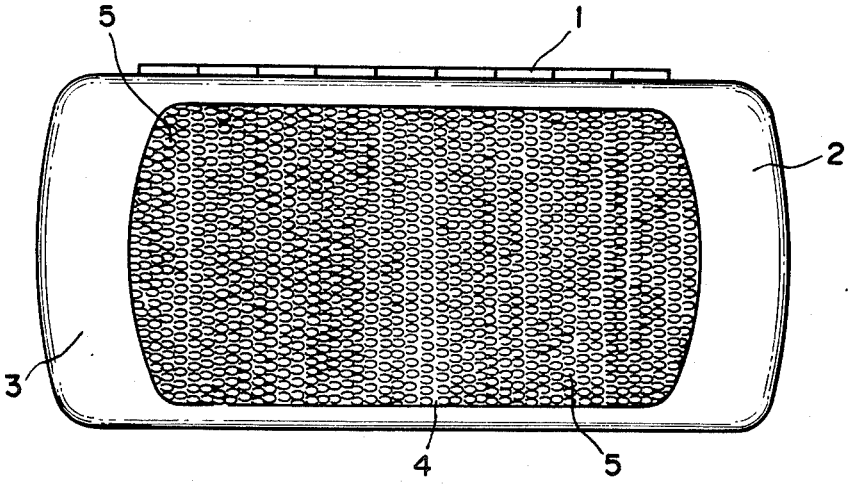
FIG. 1 shows a plan view of an embodiment of the invention.
Figure 2:
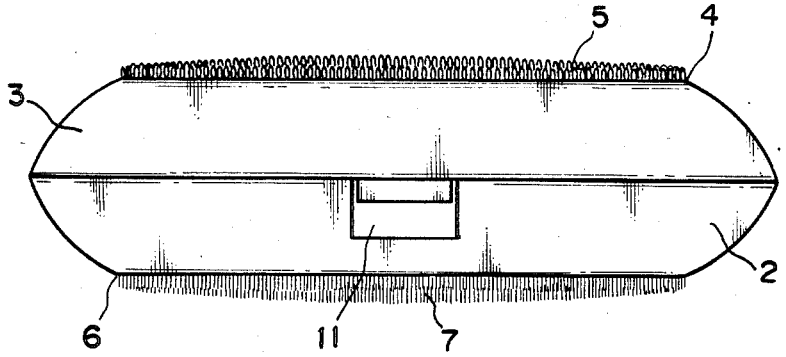
FIG. 2 shows a side view of the embodiment of FIG. 1.
Figure 3:
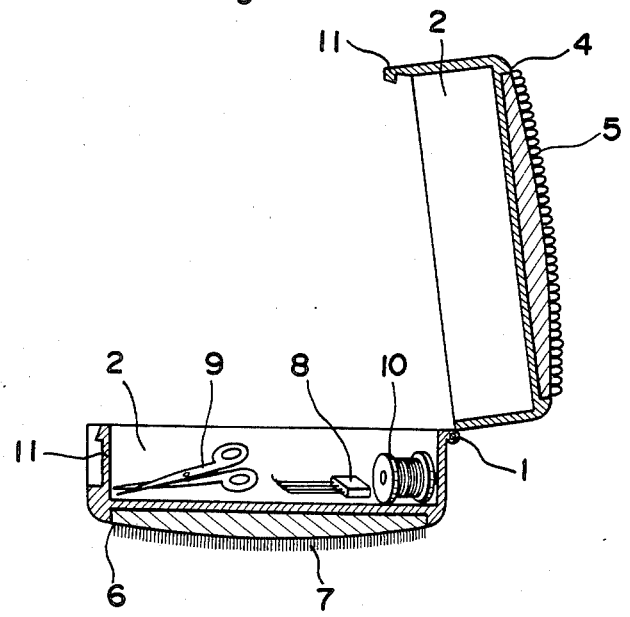
Figure 4:
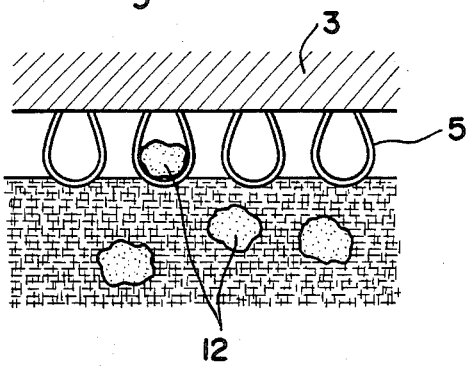

FIG. 3 shows a longitudinal sectional view of the embodiment with its lid opened; and FIG. 4 shows an enlarged view of lint on the surface of clothes being scooped up by the loops provided on the external surface of the lid 3 of a hollow box 2 which is opened and closed by hinges 1.

Figure 5:
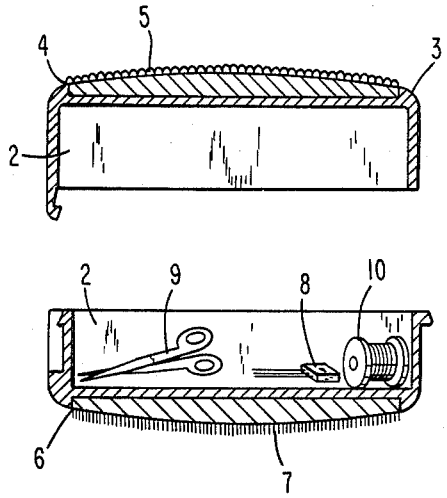

FIG. 5 shows a side view of an alternate embodiment of the invention wherein the lid is separable from the main body of the box. The cloth may be attached to the lid surface by glue or other adhesive bonding agent. The loops may be formed in the cloth by entwining nylon monofilament yarns with the wools of said plain fabrics 4, and a brush 7 made of nylon bristles is set in a cloth of nylon yarns adhesively mounted on the external bottom surface of the main body 6. Arrangements are made so that said hollow box 2 can accommodate such small articles as a fillet 8 for removing lint 12 from the loops 5, scissors 9, threads, 10, etc., and the main body 6 can engage with the lid 3 at a point 11 at a side opposite to the hinge 1.

Although the description of the inventive box structure describes the lid as being hingedly connected to the main body of the hollow box, the structure may, instead, have a connection structure wherein the lid is separable from the main body of the box. Such a structure is shown in FIG. 5.

When the hollow box 2 according to this invention is used, lint fluffs 12 which have developed on the surface of woolen clothes, blankets, etc. can be scooped up by the loops 5 provided on the lid surface 3 of said hollow box 2 by applying the loops 5 to the lint fluffs 12 and rubbing them away. The fluffs 12 caught in the loops 5 can be removed by said fillet 8 which can be taken out from inside the hollow box 2 by opening the lid 3 about the hinge 1. Next, dust on the surface of clothes or blankets can be removed by the brush 7 provided on the bottom surface of said hollow box 2.

As the loops 5 are made of such a rigid yarn as nylon monofilament, the shape of the loop is easily maintained. The loops 5 may, however, be made of a material such as metal. Further, inasmuch as woolen clothes and blankets are rubbed with a loop-shaped material, the clothes, blankets, etc. will not get hurt through rubbing. Though the conventional brush-like tools, pumiceous materials and adhesive-hardened net-shaped tools have the danger of damaging woolen or knitted goods when rubbed by the tools, this danger has completely been eliminated by this invention. Further this device is very convenient in that it further has a brush to remove dust from clothes, etc. at any time, in that the fillet 8 for removing fluffs 12 caught in the loops 5 is available by opening the hollow box 2, and in that the device can contain scissors 9, threads 10, etc. as well.

I claim:

1. A box provided with a lint remover and a dust brush including a plurality of hairs set in an external surface of a lid of the box, and a plurality of loops of rigid yarns provided on a cloth material attached to an external surface of a side of a main body of said box.

2. A box comprising a hollow main body and a lid, said box formed substantially in a shape of a substantially hollow parallelpiped, said box including a lint remover and a dust brush, said lint remover of said box including a plurality of loops made of a rigid material provided over a cloth, said cloth attached to only a first broad external surface, provided on the lid of said box, said dust brush including a plurality of bristles vertically set only in a second broad external surface, provided on the main body of the box.

3. A box provided with a lint remover and dust brush according to claim 2, wherein said loops are made of rigid yarns.

4. A box provided with a lint remover and dust brush according to claim 2, wherein said loops are made of metal.

5. A box provided with a lint remover and dust brush according to claim 2 wherein said hairs are set in a bottom external surface of the main body.

6. A box provided with a lint remover and dust brush according to claim 2, further including utensils accommodated in the hollow box.

7. A box provided with a lint remover and dust brush according to claim 6, wherein said utensils include a fillet, scissors, and thread.

8. A box provided with a lint remover and dust brush according to claim 2 including a plurality of brush areas provided on an external surface of a side of a main body thereof.

9. A box comprising a hollow main body and a lid and including a lint remover and a dust brush as recited in claim 2, wherein said lid is separable from said main body of said box.

10. A box comprising a hollow main body and a lid and including a lint remover and a dust brush as recited in claim 2, wherein said lid is hingedly connected to one side of the main body by hinge means for freely opening and closing said lid relative to said main body.

11. A box comprising a hollow main body and a lid and including a lint remover and a dust brush as recited in claim 10, further comprising engaging means on a separate side of the main body, said separate side being opposite to said one side of said main body connected by hinges to said lid, for engaging said lid to said main body of said box.

12. A box comprising a hollow main body and a lid and including a lint remover and a dust brush as recited in claim 2, further comprising engaging means for engaging said lid to said main body of said box.

13. A box comprising a lint remover and a dust brush, including a plurality of hairs set in a top external surface of the box, and a plurality of loops formed of rigid yarns and provided on a cloth material attached to a bottom external surface of a main body of said box.

14. A box comprising a lint remover and a dust brush, including a large number of loops made of a rigid material provided over a cloth attached to an external surface of a lid of said box, and many hairs vertically set in the external surface of a main body of said box, wherein the lid is separable from the main body of the box.

15. A box comprising a lint remover and a dust brush, including a large number of loops made of a rigid material provided over a cloth attached to an external surface of a lid of said box, and many hairs vertically set in the external surface of a main body of said box, wherein the lid is hingedly connected to one side of the main body by hinges so that the lid can be opened and closed freely.

* * * * *